United States Patent [19]

Briner et al.

[11] Patent Number: 4,564,454

[45] **Date of Patent: * Jan. 14, 1986**

[54] SELF-CONTAINED SEWAGE WASTE DISPOSAL SYSTEM

[75] Inventors: Clifton F. Briner, Lafayette, Ind.; William R. Bocchini, Wyckoff; Brian Wilcockson, Long Beach Island, both of N.J.

[73] Assignee: American Standard Inc., New York, N.Y.

[ * ] Notice: The portion of the term of this patent subsequent to Jan. 14, 2003 has been disclaimed.

[21] Appl. No.: 487,078

[22] Filed: Apr. 21, 1983

Related U.S. Application Data

[62] Division of Ser. No. 320,595, Nov. 12, 1983, Pat. No. 4,393,524.

[51] Int. Cl.[4] ..... C02F 9/00

[52] U.S. Cl. ..... 210/668; 210/748; 210/805; 210/806; 210/167; 210/251; 210/387; 210/916

[58] Field of Search ..... 4/318, 321; 210/805, 210/806, 167, 251, 257.1, 282, 335, 387, 499, 748, 139, 140, 916, 917, 663, 668, 266

[56] References Cited

U.S. PATENT DOCUMENTS

| | | | |
|---|---|---|---|
| 3,585,130 | 6/1971 | Gregory | 210/282 |
| 3,662,888 | 5/1972 | Kemper | 4/318 |
| 3,738,489 | 6/1973 | Kraemer | 4/318 |
| 3,751,735 | 8/1973 | Sargent et al. | 4/318 |
| 3,780,867 | 12/1973 | Zirlis | 210/282 |
| 3,950,251 | 4/1976 | Hiller | 210/282 |

*Primary Examiner*—Ivars Cintins

*Attorney, Agent, or Firm*—Hoffmann, Dilworth, Barrese & Baron

[57] ABSTRACT

A self-contained sewage waste disposal system is provided including a housing structure and a toilet bowl adapted to receive human waste and fluid for diluting the waste, transporting the waste and rinsing the bowl is provided in the housing structure. A removable filter cassette is placed in the housing structure in communication with the toilet bowl. The bowl is adapted to be flushed to dump the contents into the filter cassette and to be subsequently refilled. The coarse and fine particles of solid waste material are separated from the fluid received from the bowl by filter material in the cassette. The solid material is stored in the cassette in a compact manner for subsequent disposal upon removal of the cassette from the housing. A pump and interconnected conduits in the housing transport fluid from the interior of the system to fill the bowl after a flush, to transport filtered fluid from the filter cassette to a position for recirculation, and to transport excess fluid from the interior of the housing to the exterior thereof. The recirculated fluid is sanitized and deodorized in the housing. Controls are provided to pass the fluid through the system to facilitate the collection and disposal of sewage waste within the system in a predetermined sequence.

27 Claims, 11 Drawing Figures

FIG. 6
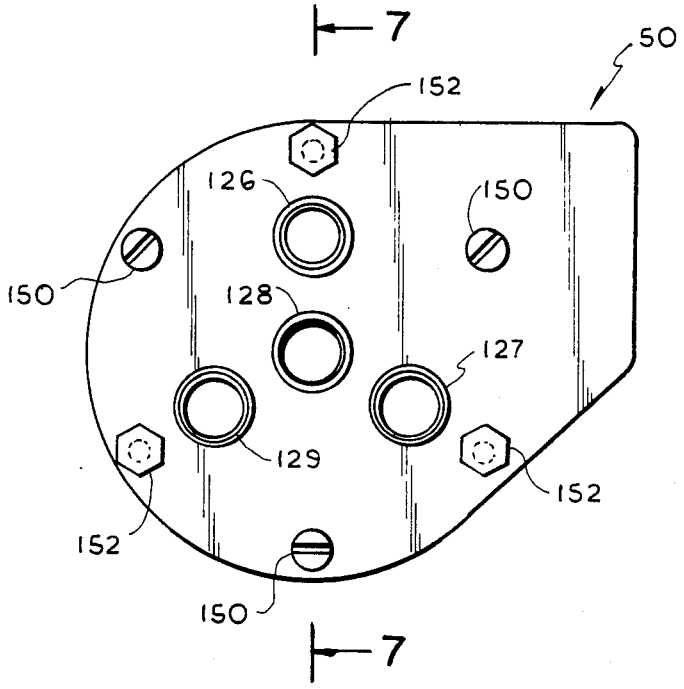
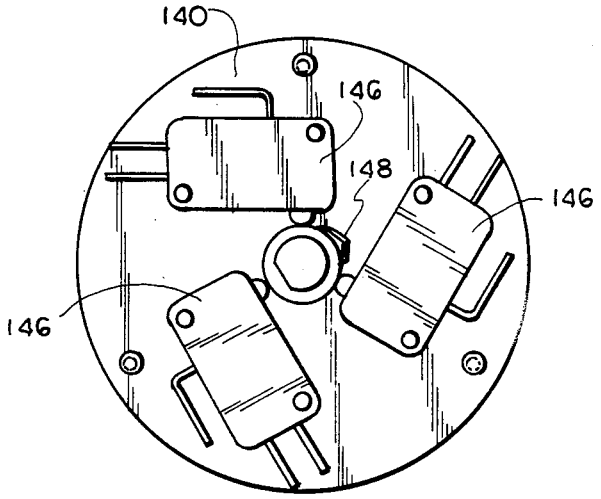
FIG. 8

SELF-CONTAINED SEWAGE WASTE DISPOSAL SYSTEM

This is a division of application Ser. No. 320,595, filed Nov. 12, 1983, now U.S. Pat. No. 4,393,524.

BACKGROUND OF THE INVENTION

Marine sanitary devices in particular and waste disposal system in general have been proceeding through an evolutionary process for a number of years. The Environmental Protection Agency (EPA) has issued various specifications regarding requirements for processing liquid and solid human waste as set forth in 33 CFR 159. Sewage or waste disposal basically requires that under certain circumstances, substantially all of the solid waste be removed from any liquid discharged from a vessel. In many instances recirculation of the fluid, for example water, is desirable.

Separation of solid waste and collection can be accomplished in a variety of different well known manners. The difficulty resides in storage and disposal. Clearly improvements in this area are necessary particularly when stringent EPA sanitary regulations are taken into consideration and criteria such as size, cost and efficiency of operation are kept in mind.

SUMMARY OF THE INVENTION

With the above background in mind, it is among the primary objectives of the present invention to provide a system for processing liquid and solid human waste in a manner consistent with the stringent requirements of the United States EPA. The system includes a self-contained unit including a removable disposable filter media cassette designed to achieve "white glove" servicing of the system. The system is compact and the cassette can be interconnected with a toilet bowl and packaged beneath the toilet bowl in a compact arrangement which is particularly useful in confined areas such as found in marine use.

It is also an objective to utilize low cost filtration materials to achieve minimum cost per flush of the system. Also, the system is energy efficient and only a small amount of electrical power is required for use. Furthermore, the system requires no chemical additions for sanitizing purposes.

A unique two stage filtration process is incorporated in the cassette with initial phase separation that satisfies United States EPA requirements for suspended solids.

More particularly, the basic objective of the system is achieved with the use of a filter cassette which is removable and disposable and acts in cooperation with a toilet bowl. The cassette is designed to roll a filter material about a spindle or take up roll assembly. Solid waste material is rolled up into the take up roll. Two stage filtration can be accomplished by first screening out or projecting out with the aid of a flapper design the majority of the solid waste ingredient. A second stage or solids removal is achieved with a filter media such as an unwoven plastic fabric. The two stage filter material method employs one roll of screen and one roll of filter media positioned adjacent to one another and adapted to be rolled together onto the take up roll. The first stage of separation through the screen material removes approximately 97% of the solids from the fluid. The majority of the remaining 3% of the solids is collected by the second stage filter in the form of the filter media. When the filter is fully rolled up it can be replaced by removing the filter cassette and replaced by a new one. The filter cassette can then be disposed in a simple and clean manner.

A still further objective of the invention is to provide a unique take up roll including a triangular configuration which facilitates directing the larger portion of the solid waste on the filter material with the material wrapping around the roll for collection and storage.

Also among the objectives of the present invention is to provide increased storage capacity for solid material in the unique filter cassette design. Conventional disposal filter devices usually are fully loaded when they have collected solids in a quantity of approximately 1 to 5% of the total volume of the device. In the present invention, the two stage filter concept permits separation of very large quantities of solid material from the fluid which is then conveyorized into storage. The screen material and finer filter media are both wrapped around the take up roll because screen material provides additional traction for moving the solid material onto the roll. As the solid material is entering the area of the take up roll there is a tendency for it to compress or extrude through the coarse screen material. The fine filter media is immediately behind the coarse filtering screen material and stops or prevents the possibility of extrusion. By the time the filter cassette is totally used up, approximately 40 to 50% of its volume has filled with waste plus the filter material. Conventional disposable filter devices would have to be 10 to 20 times lager to do the same job.

It is an objective of the invention to provide a toilet bowl as part of this system for receiving human waste and to contain fluid for dilution of the waste, transporting of the waste material from the bowl into the filter cassette, and also to assist in rinsing or cleaning the bowl. It is contemplated that appropriate electro magnetic flush valve controls can be used to maintain the fluid in the bowl until such time as the operator commands the dumping of the bowl contents and a subsequent refilling of the bowl with clean recycled fluid.

The unique filter cassette has two prime functions, first to separate both the coarse and fine solid particles from the fluid and second to store the solids in a compact manner for subsequent disposal.

A further objective is to provide a system incorporating a fluid pump to transport fluid from the interior of the system to fill the toilet bowl after a flush, to transport fluid from the filter cassette beneath the filter material and place it on top of the filter material to provide recirculation, and to transport fluid from the interior of the system when it is in excess. The excess fluid is transported out through the exterior of the unit to a location determined by an effluent pipe.

Appropriate valving structure is provided to facilitate control, storage and direction of the fluid in the sequence set forth above.

Also incorporated in the system is a decoloring cell, for example a carbon canister, for the purpose of removing color from the recirculated system fluid as well as providing fine filtration. The decoloring is achieved by activated carbon adsorption. The fine filtration is achieved through the "deep bed effect" of the carbon particles.

A further objective is to provide a system incorporating an electrolytic cell for conversion of the chlorides normally found in human urine into chlorine compounds which in turn are capable of sanitizing and deodorizing the recirculated fluid.

Also contemplated as part of the system is a coloring cell located in the toilet bowl flush circuit and provided to function in the conversion of the slightly yellow tinted cloudy fluid into a masked blue solution to improve its aesthetic appearance in the bowl.

Also, an appropriate arrangement of electronic controls are provided to separately flush, filter and recirculate fluid containing only liquid waste; flush, filter and recirculate fluid containing solid waste while collecting and storing the solid waste in a unique filter cassette, store the filtered fluid for recirculation and reuse, dispose of excess fluid in the system when desired, and collect and store solid waste while filtering the fluid therefrom and collecting the fluid for recirculation and reuse, and indicate when a filter cassette is advanced and when it is in condition for replacement.

Suitable controls are also provided to facilitate replacement of the filter cassette and carbon canister without dismantling or substantially affecting the remainder of the system. The replacement can be accomplished in a quick efficient and clean manner.

The present system is capable of being utilized in marine environments, camping sites, construction locations, mobile vehicles, and other similar places where self-contained waste disposal systems are applicable.

In summary, a self-contained sewage waste disposal system is provided. The system includes a housing structure and a toilet bowl adapted to receive human waste and fluid for diluting the waste, transporting the waste and rinsing the bowl in the housing. A removable filter cassette is in the housing in communication with the toilet bowl. Means is provided for flushing the bowl and dumping the contents into the filter cassette and for subsequent refilling of the bowl. Filter means in the cassette is provided for separating the coarse and fine particles of solid material from the fluid received from the bowl. Storage means is in the cassette to store the solid material in a compact manner for subsequent disposal upon removal of the cassette. Pump means including interconnected conduits in the housing is provided to transport fluid from the interior of the system to fill the bowl after a flush, to transport filtered fluid from the filter cassette to a position for recirculation, and to transport excess fluid from the interior of the housing to the exterior thereof. Means is in the housing and positioned to sanitize and deodorize the recirculated fluid. Control means is provided to pass the fluid through the system to facilitate the collection and disposal of sewage waste within the system in a predetermined sequence.

With the above objectives among others in mind, reference is made to the attached drawings.

BRIEF DESCRIPTION OF THE DRAWINGS

In The Drawings

FIG. 6 is an end plan view of a valve assembly for controlling fluid flow in the system of the invention;

FIG. 8 is a sectional view thereof taken along the plane of line 8—8 of FIG. 7;

DETAILED DESCRIPTION

System 20 as shown includes a compact housing structure 22 which provides a decorative and attractive enclosure for the system components as well as providing a weight support contoured for the user. All of the components of system 20 are incorporated within the housing and thus it is an entirely self-contained system designed for disposal of sewage waste. In this manner, it is particularly useful in the marine environment and more so since it will satisfy certain stringent EPA requirements for handling of human waste.

Figure 1:
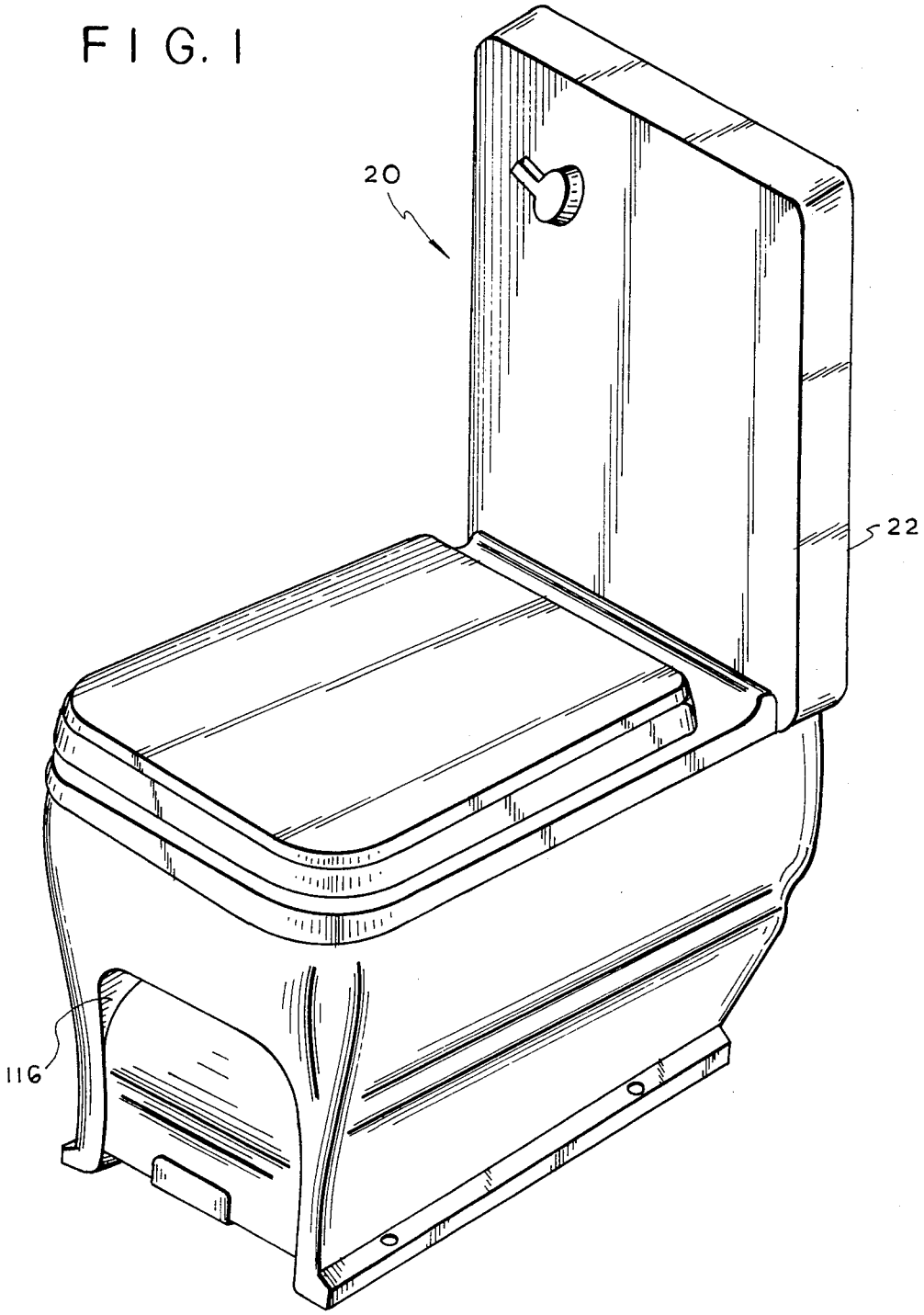
FIG. 1 is a perspective view of the self-contained sewerage waste disposal system of the present invention.
Figure 2:
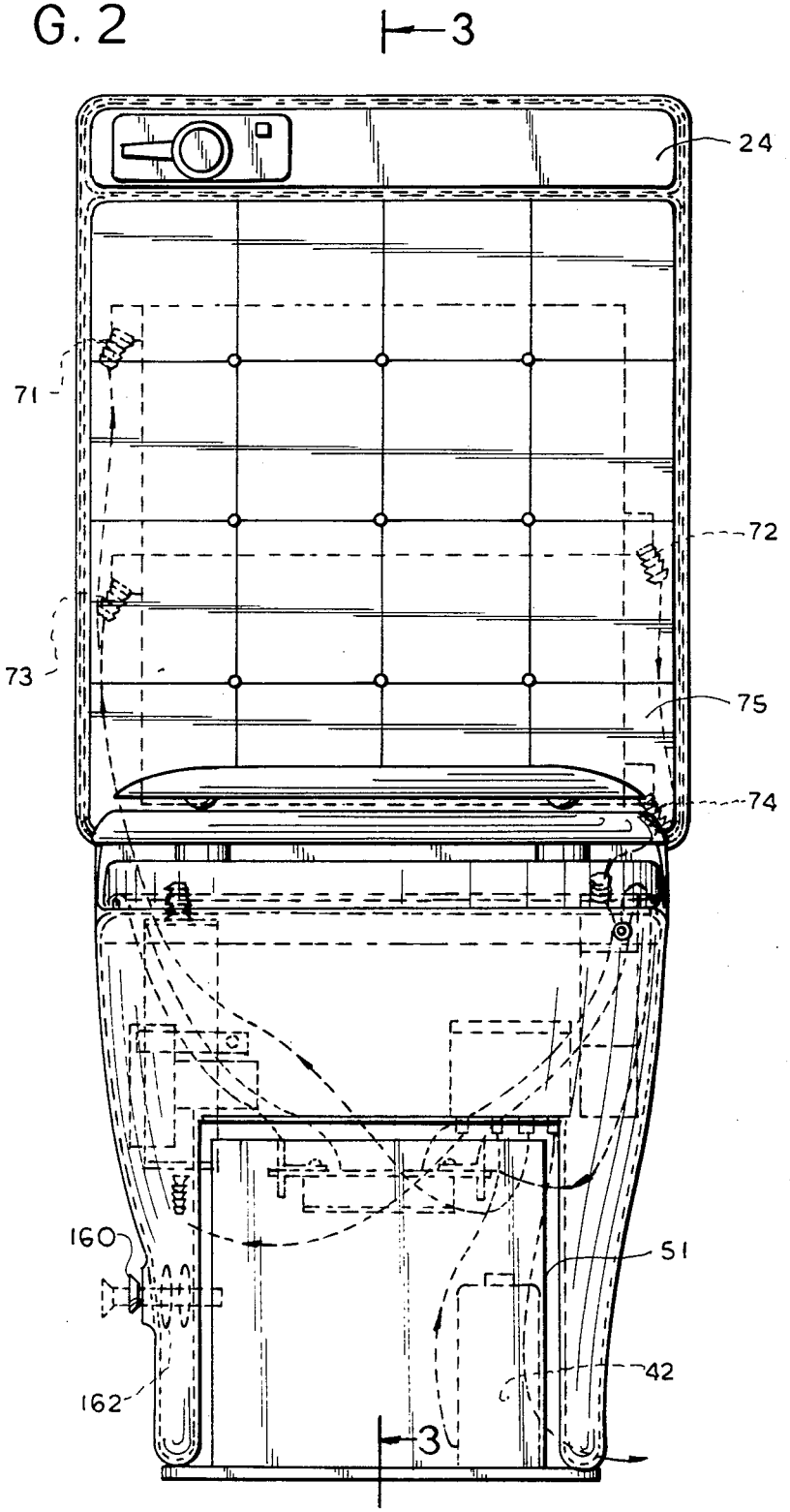
FIG. 2 is a sectional front view thereof.
Figure 3:
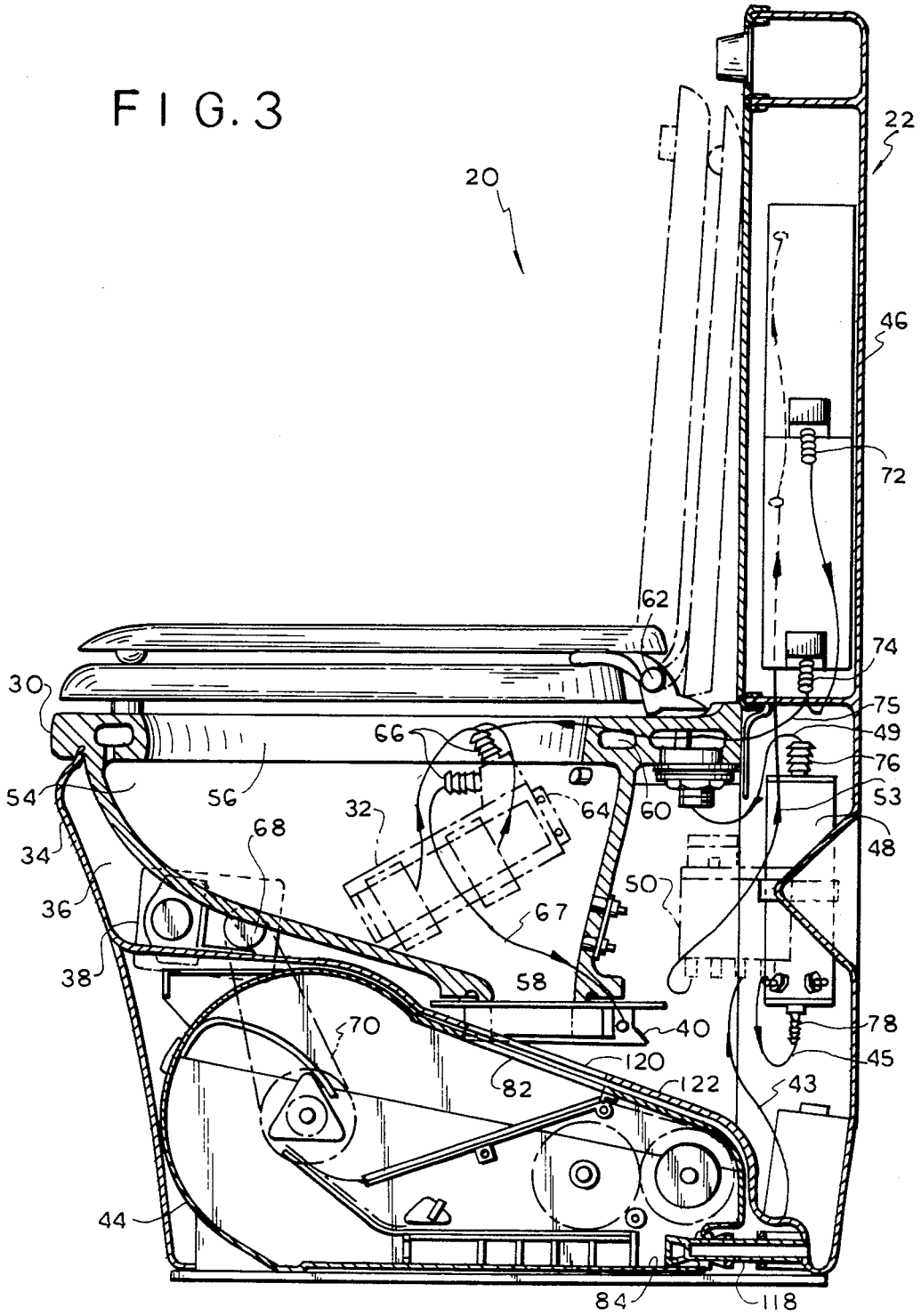
FIG. 3 is a sectional side view thereof taken along the plane of line 3—3 of FIG. 2.

The basic parts of system 20 within housing 22 are shown in FIGS. 1-3 and include a control panel assembly 24 positioned within the upper portion of the housing and encaptured by a cover panel assembly 26. A conventional seat and cover arrangement 28 is positioned on the housing for the user and is aligned with a bowl assembly 30 on the housing and extending within. An electrolytic cell assembly 32 is positioned within housing 34.

The bowl extends within lower portion 34 of the housing 22 which has a hollow interior 36. Mounted within the interior of housing portion 34 is a motor assembly drive 38. A flush valve assembly 40 is in the interior 36 and is supported at the bottom opening in the bowl assembly 30.

A pump 42 is in the lower rear portion of the housing interior 36. Removably positioned within the bottom end of housing portion 34 is a filter cassette assembly 44. In the upper portion of housing 22 a decoloring cell assembly 46 is mounted and a coloring cell assembly 48 is mounted below the decoloring cell 46 and is in the lower portion of the housing 22. A four way valve 50 is positioned adjacent the coloring cell and mounted within the interior of the lower portion of the housing.

All of the components are mounted in a conventional manner and are interconnected in the desired manner for operation of the system as described in detail below by appropriate tubing.

Toilet bowl assembly 30 is a conventional type of bowl shaped device, of ceramic or other conventional material, for receiving human waste. The bowl 30 is bolted to the housing by a conventional bolt assembly, has a hollow interior 54, a large upper access opening 56 at the top and a smaller discharge opening 58 at the bottom for discharge or dumping of the waste material collected therein. A conventional flush ring 60 surrounds the upper rim portion of the bowl assembly 30. The flush ring is conventionally connected for introduction of fluid. Fluid introduced through the flush ring into the bowl is normally retained in the bowl for dilution of the waste. This fluid adds in the transport of the waste material from the bowl into the next stage of the system 20. The bowl fluid also assists in rinsing or cleaning the bowl.

Seat and cover assembly 28 is shown in the closed position in FIG. 3 and in phantom is shown in the open position hinged in a conventional manner about pivot pin 62. Naturally one or both of the seat and cover components can be shifted between the open and closed positions.

Flush valve 40 is an electromagnetic flush valve normally closing discharge opening 58 at the bottom of the bowl. In this manner, flush valve 40 is used to maintain the fluid in the bowl until such time as the operator commands the dumping of the bowl contents and a subsequent refilling of the bowl with clean recycled fluid.

Electrolytic cell assembly 32 is mounted on the interior of the housing by a conventional mounting plate 64 and extends downward allowing gas bubbles to leae its enclosure. Appropriate connectors 66 extend from the electrolytic cell for circulating fluid through the cell. The purpose of the circulation is to convert the chlorides found normally in human urine into chlorine compounds which in turn are capable of sanitizing and deodorizing the recirculated fluid within the system.

The motor and drive assembly 38 is also mounted in a conventional manner to the interior of the housing and includes a drive shaft 68 interconnectable by a suitable chain 70 to an extending shaft on the filter cassette for advancing a take up roll within the cassette. The motor and drive assembly is a conventional well known commercial product.

Pump 42 is also a conventional commercially available product and is the type of fluid pump which can accomplish three functions within the system 20. It is used to transport fluid from the interior of system 20 to fill the toilet bowl 30 after a flush. It also transports fluid from the filter cassette 44 beneath the filter material in the cassette and places it on top of the filter material to provide for recirculation. It also transports fluid from the interior of the system when it is in excess. This fluid is transported out through the exterior of the unit to a location determined by an effluent pipe.

The pump 42 is beneath a coloring cell 48 which is vertically aligned with a decoloring cell 46. Appropriate fluid connections are made for recirculation of fluid through the decoloring cell by means of connectors 71, 72, 73 and 74 and similarly, circulation of fluid through the coloring cell during bowl refill is accomplished by means of connectors 76 and 78. Decoloring cell 46 is a common type of element in waste disposal systems generally referred to as a carbon canister and is for the purpose of removing color from the recirculated system fluid as well as providing fine filtration. The decoloring is achieved by activated carbon adsorption. The fine filtration is achieved through the "deep bed effect" of the carbon particles. Common commercial alternatives are acceptable as well for color removal and for fine filtration.

The coloring cell 48 is located in the toilet bowl flush circuit and functions to convert the slightly yellow tinted cloudy fluid into a masked blue solution to improve its aesthetic appearance in the bowl.

Figure 10:
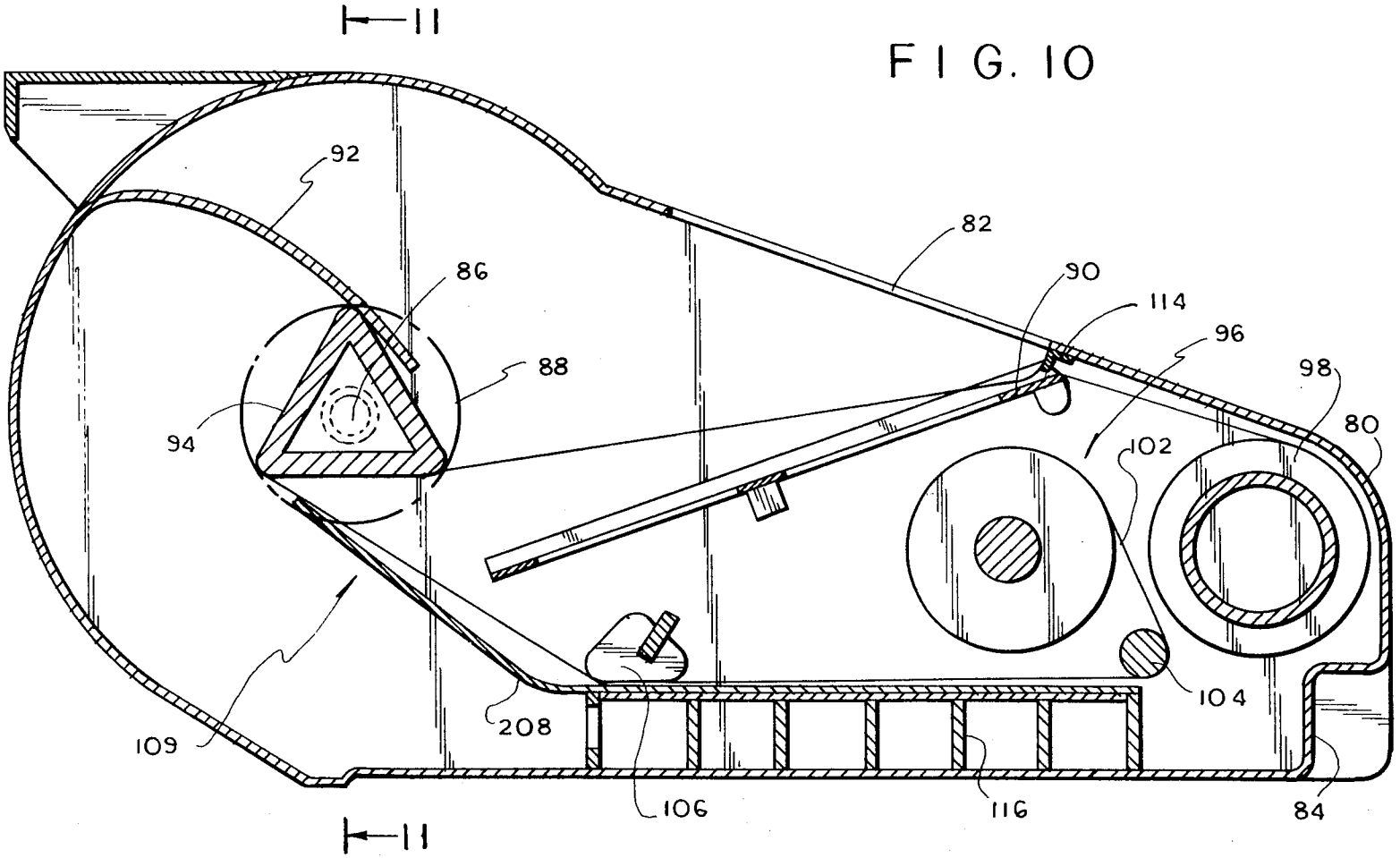
FIG. 10 is an enlarged sectional view of the filter cassette used in the system of the invention.
Figure 11:
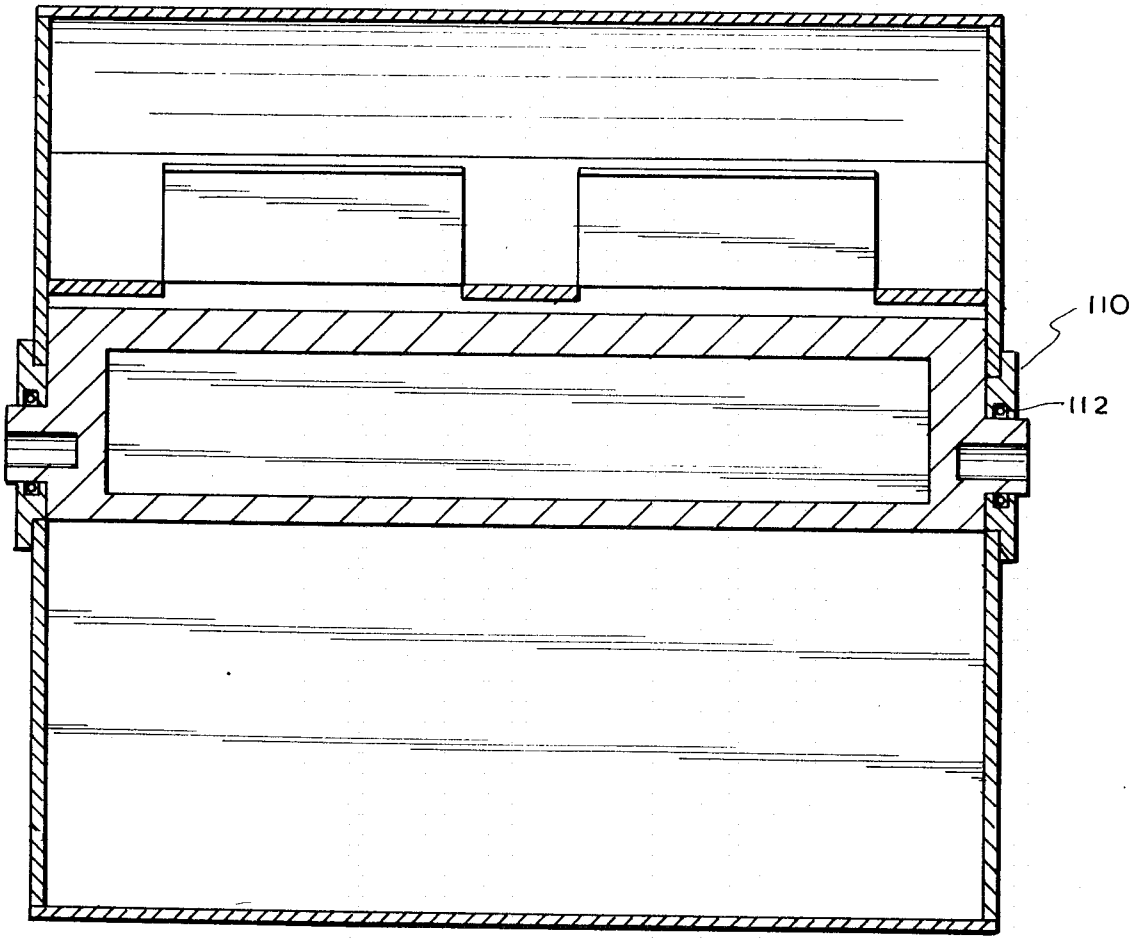
FIG. 11 is a sectional view thereof taken along the plane of line 11—11 of FIG. 10.

Filter cassette assembly 44 is removable from housing structure 22 for disposal and replacement. The details of filter cassette 44 can be best seen in FIGS. 10 and 11. The cassette 44 includes a casing 80 to house the filter components. The shape of the casing is designed to conform with the available space in the bottom of the housing 22 of system 20 to facilitate formation of a compact low cost self-contained structure.

An entrance opening 82 is in the upper side of the cassette for introduction of the waste material to be filtered. A suitable female disconnect 84 is at the bottom rear of the casing of a cassette for removal of filtered fluid for further treatment and recirculation and reuse. A horizontal shaft 86 is mounted for rotation within casing 80 and extends outwardly through a side opening in the cassette to be keyed to an external drive shaft 88 attached to chain 70 from the motor assembly 38 to thereby drive and rotate the shaft 86 when the filter cassette is placed in the system, interconnected therein and flushed.

A pressure plate 90 is in the casing and affixed at one end thereto and aligned with entrance opening 82 in the upper side of the casing. The pressure plate 90 provides support for the filter material passing thereover and extending above the plate and the solid waste material collected thereon.

A splash guard 92 extends interiorally of the casing in cantilever fashion into overlying and resilient engagement with take up roll 94 to prevent undesirable bypassing of waste as it is being stored on the roll. Take up roll 94 is mounted in fixed position on rotatable shaft 86 to rotate therewith when it is driven by the motor and drive assembly and thereby advance filter material within the cassette and collect solid waste thereabout. In addition to the take up roll within casing 80 a pair of supply rolls 96 and 98 are mounted in the casing and are spaced from take up roll 94. The rolls are positioned so that filter material from both of the supply rolls 96 and 98 will pass across the casing beneath entrance opening 82 and then will travel onto the take up roll 94 for collection.

Supply roll 98 contains a coarse filter material or screening material 100 which will first contact the waste discharged into the cassette and separate the majority of the solid particles contained therein. The other supply roll 96 includes a fine particle filter media 102 for secondary filtering of the waste material which is predominantly fluid that has passed through the screening filter material 100. Thus, fine filter media 102 provides a secondary filtering action. Both supply rolls 96 and 98 are rotatably mounted within the casing about suitable horizontal axes and are positioned adjacent to one another and substantially spaced from the take up roll 94.

The coarse filter material 100 extends from the upper side of supply roll 98 and is supported intermediate its travel path by pressure plate 90. It then extends unsupported into direct engagement with the exposed surface of take up roll 94.

The coarse filter material 100 extends from the upper side of supply roll 98 and is supported intermediate its travel path by pressure plate 90. It then extends unsupported into direct engagement with the exposed surface of take up roll 94.

Material 102 from supply filter roll 96 takes a somewhat different path. It extends about roller guide 104 mounted beneath the supply roll 96 in the casing and then extends beneath screen material 100 over the portion of the cassette where waste material will travel through onto the filter. The filter guide 106 then directs the filter media 102 onto the take up roll 94 with the coarser or screen filter material 100 being captured between the outer surface of roll 94 and the inner surface of filter media 102.

A filter table 108 is fixed in position in the casing beneath the filter material and provides a further support for the filter material.

After the take up roll enlarges through the storage of waste it then comes in contact with filter table 108 which supports filter media 102 and keeps it from sagging due to the weight of recirculated fluid.

Filter table 108 includes a resilient cantilever end portion 109 to apply compression to the filter material being collected on the take up roll and support the exterior of the roll as it enlarges.

A suitable conventional collar 110 is provided where the take up roll extends through opposing side apertures in the casing for keying and interconnection with the motor and drive assembly. Collar 110 is a conventional sealing means to prevent leakage at those apertures in the casing and to facilitate journaling and rotation of the shaft of the take up roll. To facilitate the seal a conventional O ring 112 can be mounted within the collar 110 and in engagement with the outwardly extending shaft of the take up roll.

A further splash guard 114 is positioned adjacent the entrance opening 82 to the cassette to facilitate the prevention of waste material being dumped or splashed behind the filter supply rolls and instead being directed to the filtering portion of the screen material 100 and thereafter the secondary fine filtering media 102.

The filter table 108 is spaced from the bottom of the casing and mounted on suitable ribs 116. Table 108 includes a plurality of spaced parallel bars with the openings therebetween permitting the passage of fluid. The space beneath the filter table 108 forms a storage chamber for filtering fluid for further treatment and recirculation and reuse when it is pumped from the cassette. It also serves as a weir and allows sediment to settle out of the fluid during periods of non-use. The ribs serve to entrap the fluid to alleviate the danger of fluid contacting the roll and leaching solids and color.

Cassette 44 can be mounted in housing 22 in a quick and efficient manner and can be similarly removed for replacement after collection of waste material therein without contamination and basically with a white glove procedure. Cassette 44 is introduced through an access opening 116 in the front of the bottom portion 34 of housing structure 22. It is introduced completely within the housing until male disconnect 118 from pump 42 passes through female disconnect 84 in the bottom of the casing of the cassette into communication with the storage chamber for filtered fluid in the bottom of the casing. At the same time, chain 70 and interconnected conventional connecting structure is attached to a portion of the take up roll 94 extending outwardly of the casing of the cassette to provide for drive and rotation of the take up roll. In this position, entrance opening 82 in the upper side of the casing is in alignment with a corresponding opening 120 in a surrounding plenum on the interior of housing structure 22 which generally conforms with the outer upper configuration of the cassette. The two aligned apertures 120 and 82 are also in alignment with the discharge opening 58 from the bowl 30. In this condition, the cassette 44 is in position and ready for use as part of system 20.

It should also be noted that cassette 44 is affixed or locked in position by means of a reciprocally shiftable locking pin 160 passing through aligned apertures in the housing structure 22 and the casing of cassette 44. Withdrawal of the pin 160 as shown in phantom in FIG. 2 will remove the end of the pin from the cassette casing and permit removal of the cassette for disposal and replacement. Spring 162 surrounding the pin normally biases the pin into locking position in the casing of the cassette.

Four way valve 50 is shown in detail in FIGS. 6–9. The valve housing 124 includes connector ports 126, 127, 128 and 129 extending through a front cover 130. A spacer 132 spaces the cover 130 from the back cover 134. A vane 136 is within the spacer 132 and adjacent to the inner wall of back cover 134. A second spacer 138 is positioned between the outer surface of the back cover 134 and a mounting plate 140. A cam shaft 142 extends through a central opening in back plate 134 and is rotatably mounted in position. The vane is mounted on the cam shaft 142 to rotate therewith and sequentially close and open the ports. A suitable O ring seal 144 is located in the central aperture through the back cover plate to seal against the outer surface of the cam passing therethrough. A group of three micro switches 146 are annularly spaced about the inner surface of mounting plate 140 in position to be sequentially actuated by a cam 148 on cam shaft 142 as it is rotated. These are conventional commercially available micro switches.

Since the valve assembly is a four way valve assembly, there are four ports in front cover 130 with three of the ports being annularly arranged around the central port 128 as shown in FIG. 6.

Screw and nut arrangements 150 serves to interconnect the bottom of the front and rear cover plates and spacer 132 positioned therebetween by passing through aligned apertures in those three elements. Similarly, screw, nut and washer assemblies 152 passing through aligned apertures interconnects the upper ends of front cover plate 130, rear cover plate 134 and spacer 132 and also connects therewith spacer 138 and mounting plate 140. In fact, as shown in end view in FIGS. 6 and 9, there are three annularly spaced screw assemblies 150 and similarly three annularly interspaced screw assemblies 152 about the periphery of the valve assembly 50. In this manner, all of the components are retained in fixed position.

Mounted on the exposed face of mounting plate 140 is a conventional gear motor 154 of a commercially available type. The rotatable drive shaft 156 of the motor extends through a central aperture in the mounting plate and into a recess in cam shaft 142. In this manner, the cam shaft and motor are mounted together with the assistance of a set screw 158 projecting through a side orifice in the cam shaft and into engagement with the drive pin of the motor. Thus, rotation of the motor shaft 156 will rotate the cam shaft and accordingly the cam 148 will actuate the three micro switches 146 in sequence. Four way valve assembly in this form is then mounted in fixed position in a conventional manner within system housing structure 22 and is interconnected for facilitating operation of fluid flow within the system in the manner described below. The operation of valve 50 is such that a voltage is supplied to motor 154 through a selected normally closed micro switch 146 upon the command of the electronic control circuit in the system through a relay. Each micro switch 146 corresponds to a desired position for the valve 50, which when moved to this position will cause cam shaft 142 attached to the output shaft 156 of the motor to break the electrical supply to the motor in accordance with the circuitry arrangement for the plurality of micro switches 146. In this manner, the flow through the valve 50 is channeled through the required passages to perform the necessary functions in the system 20. The vane 136 serves to block the chosen outlet port 126, 127 or 129 depending on rotation of the cam 142 to which it is attached. The central inlet port 128 is thus sequentially brought into communication with one or more of the outlet ports to provide the desired flow path in the system at any given point in time. Each outlet port is designed for a particular function in the system, a flushing operation, a recirculation of fluid operation, removal of excess fluid or effluent. It is contemplated that a valve assembly of this type can be made entirely of inexpensive material such as plastic with the exception of the shaft and motor combination which is normally formed of non-corrosive steel.

Filter cassette 44 receives fluid from the toilet bowl passing through flush valve 40 into the filter cassette 44. The primary function of the cassette 44 is to separate both the coarse and fine solid particles from the fluid. A second function of the cassette is to store the solids in a compact manner for subsequent disposal.

The conduits for fluid flow through the system 20 can be best seen in FIGS. 2 and 3 with arrows showing the direction of flow. Pump 42 pumps fluid through conduit 43 into the four way valve 50. One outlet of the valve 50 is for directing fluid through conduit 45 through connector 78 into the bottom of the coloring cell 48. Fluid exiting from the coloring cell 48 travels through conduit 49 extending from connector 76 at the upper end of the coloring cell. Conduit 49 extends into communication with the flush ring assembly through which the fluid is introduced to the interior 54 of the toilet bowl. A second outlet from four way valve 50 is interconnected with conduit 51 for directing effluent fluid from the system when that appropriate valve outlet or connector port is opened.

The remaining outlet port of four way valve 50 is interconnected with conduit 53 which communicates and is attached to the two entrance connectors 71 and 73 of decoloring cell 46. In this manner the fluid can be passed into the decoloring cell and exits, after being suitably treated therein, through exit connectors 72 and 74 into conduit 75. Conduit 75 extends onto inlet connector 66 of electrolytic cell assembly 32. In this manner the fluid can be introduced into the electrolytic cell for further treatment. The fluid passes from exit connector 66 of the electrolytic cell through conduit 77 through the flush valve assembly and into the base of the bowl for of fluid therethrough into the bowl. In this manner, the fluid flow functions of the system can be accomplished through the various interconnected conduits. For example, excess or effluent fluid can be discarded, fluid can be introduced for flushing of the bowl, and fluid can be directed for recirculation through the system.

Figure 4:
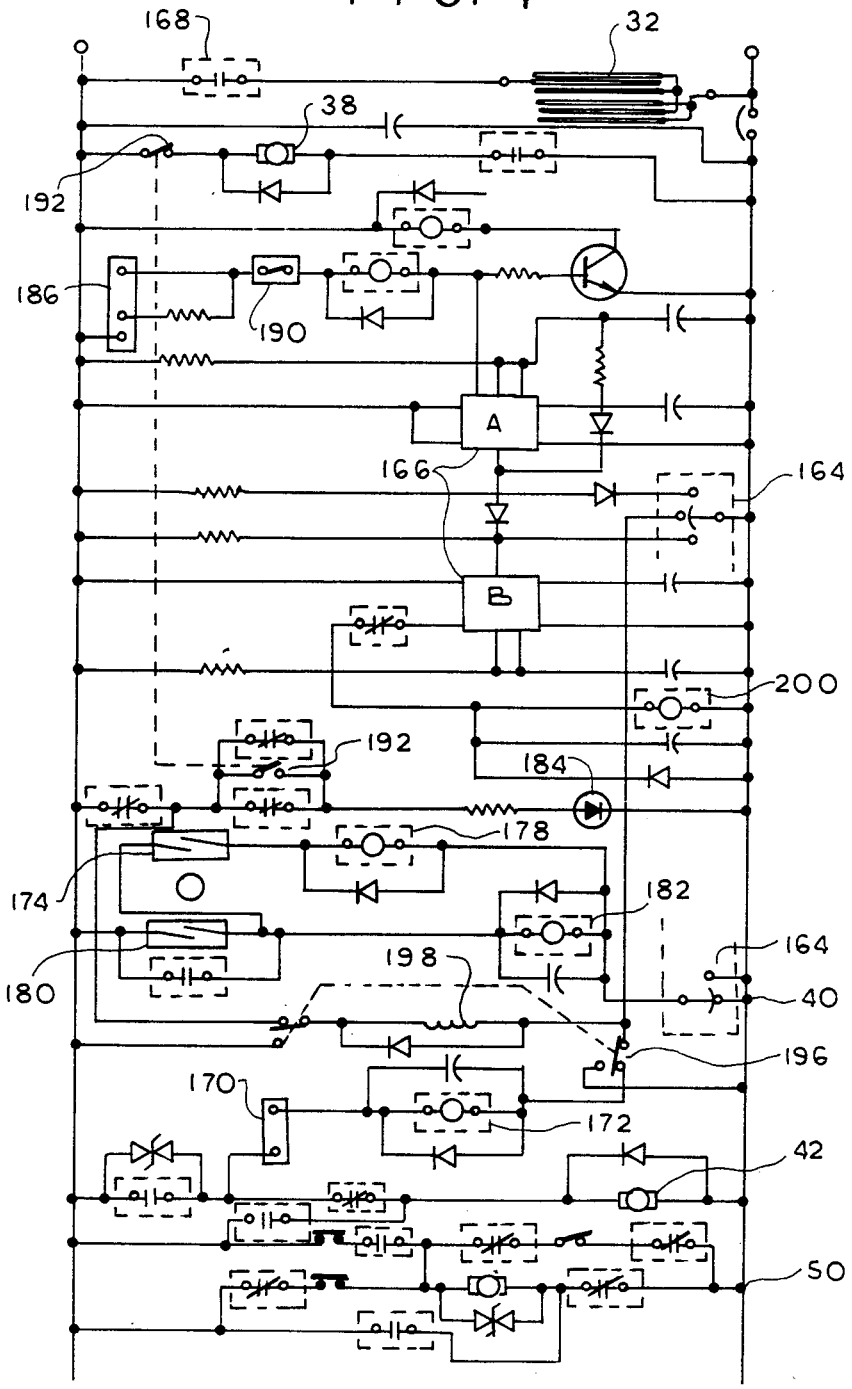
FIG. 4 is a schematic drawing of the electrical circuitry employed in the invention.
Figure 5:
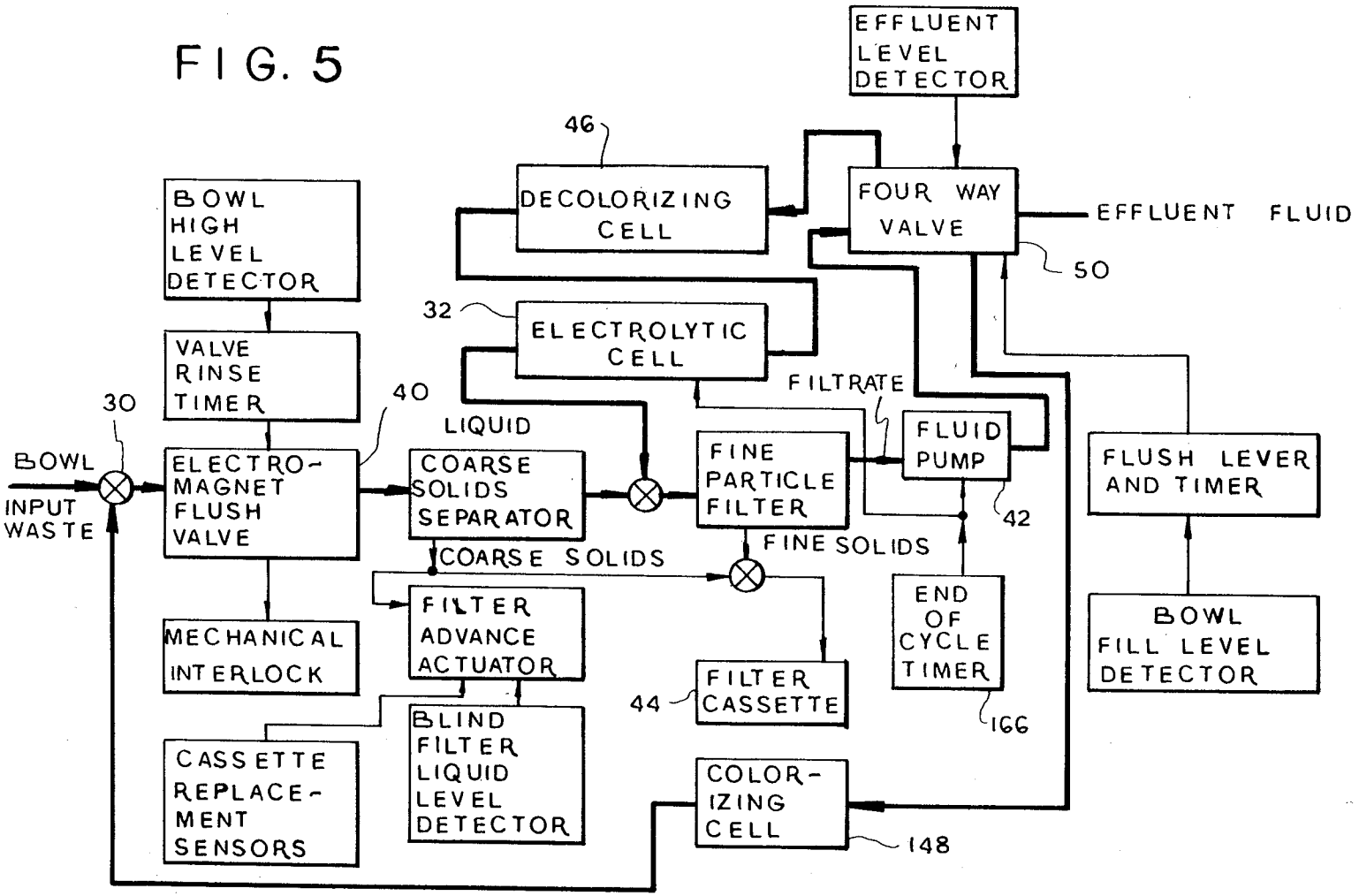
FIG. 5 is a block diagram of the sequence of operations of the system of the invention.
Figure 7:
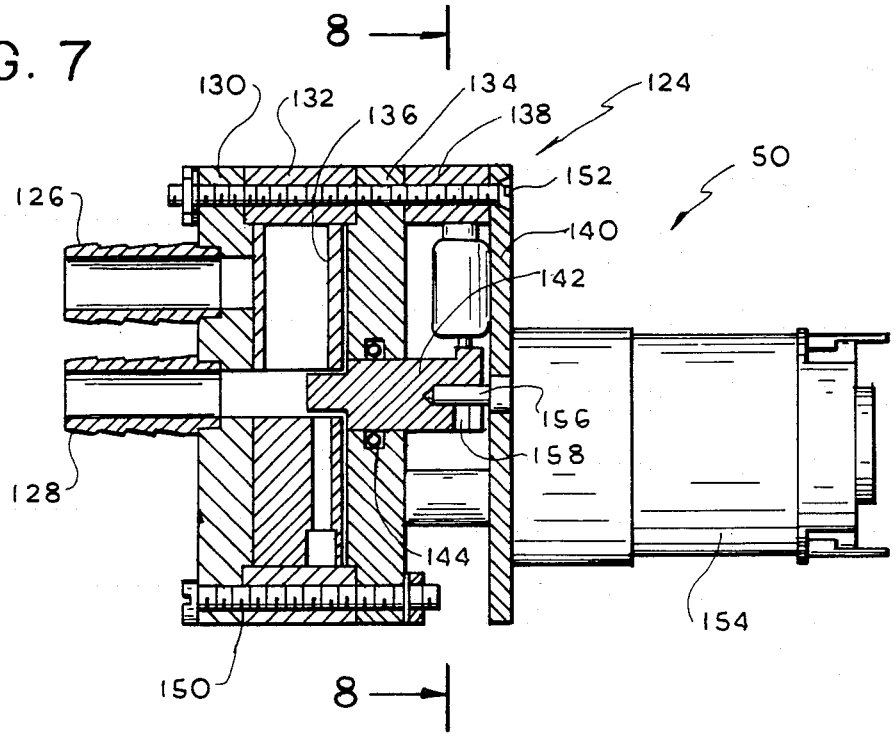
FIG. 7 is a sectional view thereof taken along the plane of line 7—7 of FIG. 6.
Figure 9:
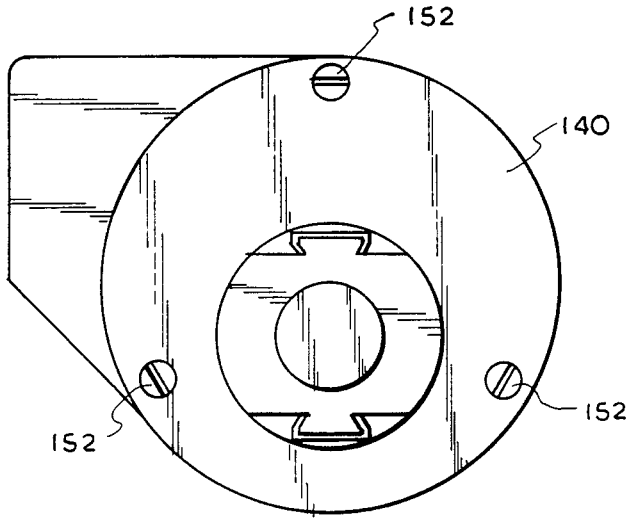
FIG. 9 is a plan view of the other end of the valve assembly employed for fluid flow in the system of the invention.

For operation of the system 20, reference is made to the schematic electrical circuitry of FIG. 4 and the flow diagram as shown in FIG. 5. The flush switch 164 is depressed to the L position. This starts the main cycle time portion of the dual solid state timer 166. This timer in turn energizes the electrolytic cell relay 168. In this manner the electrolytic cell 32 is energized. While the flush switch 164 is depressed, the flush valve coil 198 is de-energized and the bowl content is allowed to drop into the interior of the system to provide a rinshing action. As soon as the switch is allowed to spring return to its neutral position, the flush valve coil is then reenergized. At the same time as the electrolytic cell is energized the fluid pump 42 is also energized. When the flush switch is released, the pump provides the refilling of the toilet bowl with clean recycled fluid. The fluid rises in the bowl until the liquid level sensor which is called "bowl level control" 170 is electrically "made". When the switch is "made", the bowl level control relay 172 then becomes energized. This relay then causes the four way valve 50 to switch from the bowl "fill" position to the "fluid recirculation" position. This recirculation will continue until the main cycle timer 166 completes its timing cycle.

When the main cycle time period for processing the fluid is not occurring, that is the system 20 is at rest, the system can execute the detection and disposal of excess fluid from the system. This fluid is referred to as effluent. The existance of excess fluid is determined by the effluent level control switch 186. When it is "made" by the conductivity of the effluent and when the toilet system is in an approximate horizontal position as determined by the effluent level control horizontal switch 190, the effluent level control relay 188 becomes energized. This causes the fluid pump 42 to operate and also causes the four way valve 50 to direct the effluent to the effluent discharge. When the fluid level falls below the intermediate electrode of the effluent level control switch 186 the circuit is broken, and the effluent system ceases functioning.

If the flush switch 164 is depressed into the "S" position to achieve "solid flush", both the main cycle timer and the filter advanced timer portions of the dual solid state timer 166 are energized. The main cycle timer portion of the timer 166 functions in the same manner as previously described. The filter advance portion of the timer 166 causes the filter advance control relay 200 to be energized. This in turn energizes the filter advance drive motor 38. This drive motor advances the filter material in the filter cassette 44 by approximately 6 inches. Any solid waste collected on the filter material is rolled up around the take up roll 94. Relay 200 also de-energizes the flush valve coil 198 so that the unit operates in a bowl "rinse" mode while the filter material is being advanced.

While this is occurring the filter change signal light 184 is incapable of being energized. In order to verify and detect proper advancement of the filter material, a system is devised whereby a tiny amount of magnetic material 202 is implanted in the end of the filter supply roll 98 or, alternatively supply roll 96, located within filter cassette 44. Filter advance sensor switch 174 and filter advance travel sensor switch 180 are located outside of cassette 44 within system 20. As the filter supply roll 98 rotates to supply filter media at the drive take up roll 94, the magnet 202 will "make" switch 180. This in turn will energize filter advance travel relay 182. This relay establishes a hold circuit around switch 180 as well as opens one of the possible voltage paths to the filtered change signal light 184. The magnet continues to rotate until it reaches a position where it actuates the switch 174. This energizes the filter advance relay 178. When this relay is energized, it opens one of the possible paths to filter change signal light 184. It also de-energizes the filter advance control relay 200 which in turn stops the filter advance drive 38. The circuit is designed so that subsequent liquid flushes will not cause filter advance roll operation and also maintains relay 178 and relay 182 in their energized positions. If the filter media detaches from the filter supply roll, the magnet 202 will cease rotation and switch 174 and switch 180 will not close during a solid flush. This will cause relay 200 to become de-energized without energizing relay 178 or relay 182. When this sequence of events occurs, the filter change signal light 184 becomes illuminated and the filter advance drive ceases to be actuated. This light tells the operator to install a new filter cassette. If the filter roll, instead of being depleted of filter material, becomes full; the full filtered switch 192 will illuminate the filter change signal light 184 and stop the filter advance drive.

In order to have a filter cassette change the operator switches the filtered change switch 196. This action causes the flush valve coil 198 to be maintained regardless of other controls. The operator then calls for a liquid flush by depressing the flush switch 164 to the "L" position. This causes the pump 42 to provide the bowl with clean recycled fluid. The bowl level control relay 172 is disabled by the actuation of switch 196. Therefore, pump 42 continues to remove fluid from the interior of the system and place it in the bowl until no pumpable fluid remains in the system. This will be ascertained by observing that no more liquid is entering the bowl from the flush ring of the bowl. At this point cassette 44 can be removed and a new cassette installed by simply removing pin 160 from engagement with the cassette casing and biasing spring 162 to permit withdrawal of the cassette through opening 116 in the housing structure 22. The new cassette is introduced through the same access opening and the pin released so that spring 162 biases the pin into engagement with the casing of the new cassette. The other appropriate connections to the system as described above are accomplished and, thereafter, switch 196 can be switched back to the normal operating mode and the operator can give the unit a solid flush command to put it into a "ready" condition.

Replacement of the decoloring canister 46 can be accomplished at the same time as the filter cassette replacement. The decoloring contents can be either activated carbon, and other similar decoloring materials. The sequence of events related to the electrical control system are as described above. Once all the pumpable fluid is in the bowl, the pump will continue to pump until the processing period has transpired. This is controlled by the main cycle timer 166. When the pump is off, the carbon canister and filter cassette may be removed and replaced. After the new cassette and canister are in place approximately one quart of water should be added to the bowl to make up for the fluid lost in the transfer. The unit is now ready for a solid flush command to put the unit into a "ready" condition.

There are certain advantages in utilizing a triangular configuration or any other polyagonal configuration for the take up roll 94. Round spools can cause difficulty in consuming semi-solid material, such as human waste, into a storage take up roll without slippage. The triangular configuration provides straight sides leading at a point which accomplishes biting of the material and thus facilitating the breakdown, collecting and storing of the material on the roll. This is particularly advantageous when the spool size is relatively small as with a compact system of the present type. A further modification that will also work adequately would be to provide the sides of the triangularly shaped take up roll with concave surfaces. This acts in a similar manner and breakdown collection and storage of the solid waste material.

After several revolutions, the take up roll beings to round out. It eventually becomes eliptical in shape and, as the sides get larger, the included angle is such that the triangular configuration is not necessarily required and the eliptical roll will consume the semi-solid material. The variation with concave sides permits even more semi-solid material to be stored in the take up roll and minimizes the final take up roll size.

As discussed above, there are numerous advantageous features obtained with the use of a filter cassette of the present design. Improved filtering ability, white-glove service, compactness, minimum cost and minimum energy are clear advantages. Another feature of the unit is the realization that most filter devices of a disposable nature usually are fully loaded when they have collected solids in a quantity which never exceeds one to five percent of the total volume of the device. But when the filter has this much solid material in it, it becomes plugged up or blocked. The two stage filter concept utilized here is such that very large quantities of material are separated from the fluid and then conveyorized into storage. This is achieved by wrapping the coarse or screen filter material and the fine filter media around a take up mandrel or roll. The coarse media or screen material provides the traction necessary to move this solid material into the mandrel. As the solid material is entering the mandrel area, there is a tendency for it to compress or extrude through the coarse screen media. The fine filtered media is immediately behind the coarse filter media and stops or prevents the possibility of extrusion. By the time the filter cassette is totally used up, approximately forty to fifty percent of its volume has solidly filled with waste plus the filter media. A conventional type of filter device would have to be ten to twenty times larger to do the same job.

It should also be noted that the filter cassette of the present design is constructed to facilitate removal and disposal of solid waste collection stored in the device. It is provided with quick-couplings both to the fluid inlet and its fluid outlet. When it is removed for disposal, the fluid outlet automatically seals itself. The fluid inlet is "capped off". The exterior of the cassette is totally clean and bacteria free.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A method of disposing of sewage waste within a self-contained system comprising; providing a toilet bowl adapted to receive human waste and a predetermined amount of internally housed fluid in the system for diluting the waste, transporting the waste and rinsing the bowl, placing a removable filter cassette in alignment and in communication with the toilet bowl, flushing the bowl and dumping the contents into the filter cassette, filtering the fluid and separating coarse and fine particles of solid material from the fluid received from the bowl, storing the solid material in a compact manner in the cassette for subsequent disposal upon removal of the cassette from alignment with the toilet bowl, transporting fluid from the interior of the system through interconnected conduits to fill the bowl after a flush and to transport filtered fluid from the filter cassette to a position for recirculation, and removing and controlling by control means the passage of the internally housed fluid in a predetermined sequence to facilitate the collection and disposal of sewage waste without the need for introduction of external fluid to the system other than that received from human waste.

2. The invention in accordance with claim 1 wherein excess fluid is also removed from the interior of the system through the interconnected conduits.

3. The invention in accordance with claim 1 wherein recirculated fluid is sanitized and deodorized.

4. The invention is accordance with claim 3 wherein sanitizing and deodorizing of the fluid is accomplished by providing an electrolytic cell for converting the chloride normally found in human urine into chlorine compounds.

5. The invention in accordance with claim 1 wherein the filter media is drawn from the filter supply within the cassette into alignment with the opening in the cassette to receive and filter sewage waste from the toilet bowl and accumulated solid waste material is then taken up and stored within the cassette.

6. The invention in accordance with claim 5 wherein the take up means in the cassette includes a take up roll connectable to the control means for rolling up a predetermined portion of filter material and collected solid waste upon demand.

7. The invention in accordance with claim 6 wherein the take up roll is polyagonal in configuration to facilitate collection of the filter material and collected solid waste.

8. The invention in accordance with claim 7 wherein the take up roll is triangular in configuration to facilitate collection of the filter material and collected solid waste.

9. The invention in accordance with claim 6 wherein the filter material includes a first sheet of screen material having a porosity to collect the larger particles of solid waste and a second sheet of filter media positioned adjacent the first sheet of screen material to receive the fluid and smaller particles of solid waste passed therethrough and further filtering the fluid to remove additional solid waste material.

10. The invention in accordance with claim 9 wherein the first sheet of screen material extends from a supply roll across the cassette onto the take up roll and the second sheet of filter material extends from a second supply roll across the cassette and onto the take up roll, the first and second sheets of filter material being one above the other in alignment with the opening in the cassette aligned with the discharge opening in the toilet bowl.

11. The invention in accordance with claim 5 wherein detection means is provided in the control means to detect proper advancement of the filter material and to indicate when the filter material is no longer being properly supplied where the filter cassette is full whereupon the filter advance is no longer possible.

12. The invention in accordance with claim 1 wherein a storage chamber is located in the bottom of the filter cassette for collection of filtered fluid, conduit means interconnectable with the storage chamber in the cassette to pass the collected filtered fluid therethrough for recirculation.

13. The invention in accordance with claim 1 wherein valve means is provided responsive to the control means to maintain the fluid in the bowl, dump the bowl upon a flush command and subsequently permitting the refilling of the bowl with fresh fluid.

14. The invention in accordance with claim 1 wherein a coloring cell is located in the housing to provide a mask color to the fluid to improve its aesthetic appearance in the bowl.

15. The invention in accordance with claim 1 wherein controls within the system includes a flush switch, timing rinse responsive to actuation of the flush switch to operate the means in the housing for sanitizing and deodorizing the recirculated fluid, depression of the flush switch causing the fluid to be flushed from the bowl into the filter cassette and thereby providing a rinsing action, release of the flush switch causing the control means to reclose the opening in the bowl and to actuate the pump means to refill the toilet bowl with clean recycled fluid, the control means operating the stop filling of the bowl and to initiate recirculation of fluid for a predetermined time.

16. The invention in accordance with claim 15 wherein the flush switch is adapted to be shifted to a second position for disposal of solid waste material, the flush switch again actuating the timing means for dumping the contents of the bowl and additionally advancing the filter material in the cassette a predetermined amount.

17. The invention in accordance with claim 1 wherein the control means includes excess fluid sensing means for actuating the pump means to direct excess fluid from the system and to stop the pump means upon completion of removal of excess fluid.

18. The invention in accordance with claim 1 wherein the control means includes filter cassette change means including a filter change switch, and actuation of the filter change switch causes the pump means to provide the bowl with clean recycled fluid and remove fluid from the interior of the system and place it in the bowl until no pumpable fluid remains in the system, release means for permitting removal of the filter cassette and replacement after no more fluid is entering the bowl.

19. The invention in accordance with claim 18 wherein a replaceable decoloring cell is provided to decolor filtered fluid and provide for further filtering for recirculation and reuse of the fluid.

20. The invention in accordance with claim 1 wherein pump means is provided to transport the fluid through the self-contained sewage waste disposal system.

21. A filtering unit for disposal of sewage waste comprising; an enclosure, an entrance opening to the interior of the enclosure, an exit opening in the enclosure, filter means in the enclosure for filtering solid waste material from a fluid mixture containing solid waste received through the entrance opening to the enclosure, storage means for storing the separated solid waste material within the enclosure, means for directing the fluid remaining after removal of the solid waste portion to a position for removal through the exit opening in the enclosure, the filter means including a take up roll rotatably mounted in the enclosure and supply means for supplying a sheet of coarse filter material and a sheet of fine filter media, the sheets being arranged so that they pass in overlying position with respect to one another adjacent to the entrance opening of the enclosure so that the fluid mixture first contacts the coarse material whereupon the major portion of the solid waste material is removed therefrom and the remaining fluid mixture than passes to the fine filter media where virtually all of the remaining solid waste material is removed as the fluid passes therethrough, the sheets then being simultaneously collected on the take up roll with the sheet of coarse material being captured between the surface of the roll and the fine filter media to facilitate collection and storage of the solid waste material on the take up roll.

22. The invention in accordance with claim 21 wherein the coarse filter material is supplied from a first supply roll and the fine filter media is supplied from a second supply roll.

23. The invention in accordance with claim 21 wherein the take up roll has a polyagonal outer configuration to facilitate collection of the solid waste material on the take up roll.

24. The invention in accordance with claim 21 wherein the take up roll has a triangular shaped outer configuration to facilitate collection of the solid waste material on the take up roll as it is rotated to advance the sheets of filter material thereon.

25. A method of filtering and disposing of sewage waste comprising; providing an enclosure having an entrance opening and an exit opening, placing a rotatable take up roll in the enclosure, supplying a first sheet of coarse filter material and a second sheet of fine filter media within the enclosure to be collected on the take up roll, passing the sheets of filter material across the enclosure and exposed to the entrance opening with the coarse filter material between the entrance opening and the fine media, introducing a fluid mixture including solid sewage waste material through the entrance opening and onto the coarse filter material so that the major portion of the solid waste is collected on the coarse filter material with the remaining fluid mixture passing therethrough into contact with the fine filter media for further filtration of solid waste material from the fluid mixture, directing the resulting filtered fluid into position for removal through the exit opening, directing the sheets of filter material onto the take up roll including the collected solid waste material with the coarse filter material being captured between the outer surface of the take up roll and the fine filter material to facilitate collection and storage of the solid human waste material on the take up roll.

26. The invention in accordance with claim 25 wherein the coarse filter material is supplied from a first supply roll and the fine filter media is supplied from a second supply roll.

27. The invention in accordance with claim 25 wherein the take up roll has a triangular shaped outer configuration to facilitate collection of the solid waste material on the take up roll as it is rotated to advance the sheets of filter material thereon.

* * * * *